US011719013B2

(12) United States Patent
Krasnoff

(10) Patent No.: US 11,719,013 B2
(45) **Date of Patent: *Aug. 8, 2023**

(54) EARTHQUAKE STABILIZATION DEVICE

(71) Applicant: Duplicent, LLC, Santa Monica, CA (US)

(72) Inventor: Curren Emmett Krasnoff, Santa Monica, CA (US)

(73) Assignee: Duplicent, LLC, Santa Monica, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/739,656

(22) Filed: May 9, 2022

(65) Prior Publication Data

US 2022/0259881 A1 Aug. 18, 2022

Related U.S. Application Data

(63) Continuation of application No. 17/600,671, filed as application No. PCT/US2021/025563 on Apr. 2, 2021, now Pat. No. 11,339,581.

(60) Provisional application No. 63/004,712, filed on Apr. 3, 2020.

(51) Int. Cl.
*E04H 9/02* (2006.01)

(52) U.S. Cl.
CPC ..... *E04H 9/0215* (2020.05)

(58) Field of Classification Search
CPC ..... E04H 9/0215; E04H 9/023; F16F 7/1005; F16F 7/1022; F16F 15/02
See application file for complete search history.

(56) References Cited

U.S. PATENT DOCUMENTS

| | | | | |
|---|---|---|---|---|
| 4,635,892 | A | 1/1987 | Baker | |
| 5,421,129 | A | 6/1995 | Sakamoto et al. | |
| 5,666,770 | A | 9/1997 | Sato et al. | |
| 5,954,169 | A | 9/1999 | Jensen | |
| 8,777,519 | B1 * | 7/2014 | Henderson | E04H 9/0235 52/167.1 |
| 11,255,409 | B2 | 2/2022 | Mitsch et al. | |
| 11,603,821 | B2 * | 3/2023 | Mitsch | F03D 80/00 |
| 2004/0118057 | A1 | 6/2004 | Sanders | |
| 2007/0068756 | A1 | 3/2007 | Huston et al. | |
| 2017/0210597 | A1 | 7/2017 | Seki | |
| 2018/0252287 | A1 | 9/2018 | Mitsch | |
| 2021/0072413 | A1 * | 3/2021 | Ziv | G01V 1/008 |
| 2021/0230896 | A1 * | 7/2021 | Ripamonti | G05B 13/042 |
| 2021/0317676 | A1 | 10/2021 | Schneider | |

FOREIGN PATENT DOCUMENTS

WO WO-2017/146573 8/2017

OTHER PUBLICATIONS

International Search Report and Written Opinion for International Application No. PCT/US2021/025563, dated Jun. 28, 2021, 13 pages.

* cited by examiner

*Primary Examiner* — Babajide A Demuren
*Assistant Examiner* — Daniel J Kenny
(74) *Attorney, Agent, or Firm* — Greenberg Traurig, LLP

(57) ABSTRACT

A stabilization system for a building includes a stabilization assembly configured to couple to a floor structure of a building. The stabilization assembly includes a track defining a track path, a weight slidably coupled to the track, and an actuator configured to move the weight along the track path.

20 Claims, 11 Drawing Sheets

EARTHQUAKE STABILIZATION DEVICE

CROSS-REFERENCE TO RELATED PATENT APPLICATION

This application is a continuation of U.S. patent application Ser. No. 17/600,671, filed Oct. 1, 2021, which is a 371 national stage of International Patent Application No. PCT/US2021/025563, filed Apr. 2, 2021, which claims the benefit of and priority to U.S. Provisional Patent Application No. 63/004,712, filed Apr. 3, 2020, all of which are incorporated herein by reference in their entireties.

BACKGROUND

The present disclosure relates generally to systems for mitigating the impact of natural disasters on structures. More specifically, the present disclosure relates to systems for mitigating the forces and movement experienced by a building during an earthquake.

SUMMARY

At least one embodiment relates to a stabilization system for a building. The stabilization system includes a weight assembly configured to be coupled to a floor structure of the building, a seismic sensor configured to provide measurement data relating to a seismic event, and a controller. The weight assembly includes a track defining a track path, a weight slidably coupled to the track, and an actuator coupled to the weight and configured to move the weight along the track path. The controller is operatively coupled to the seismic sensor and the actuator and configured to (a) determine a target response of the weight assembly that mitigates the effect of the seismic event on the building based on the measurement data, and (b) control the actuator to move the weight along the track path according to the target response.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Figure 1:
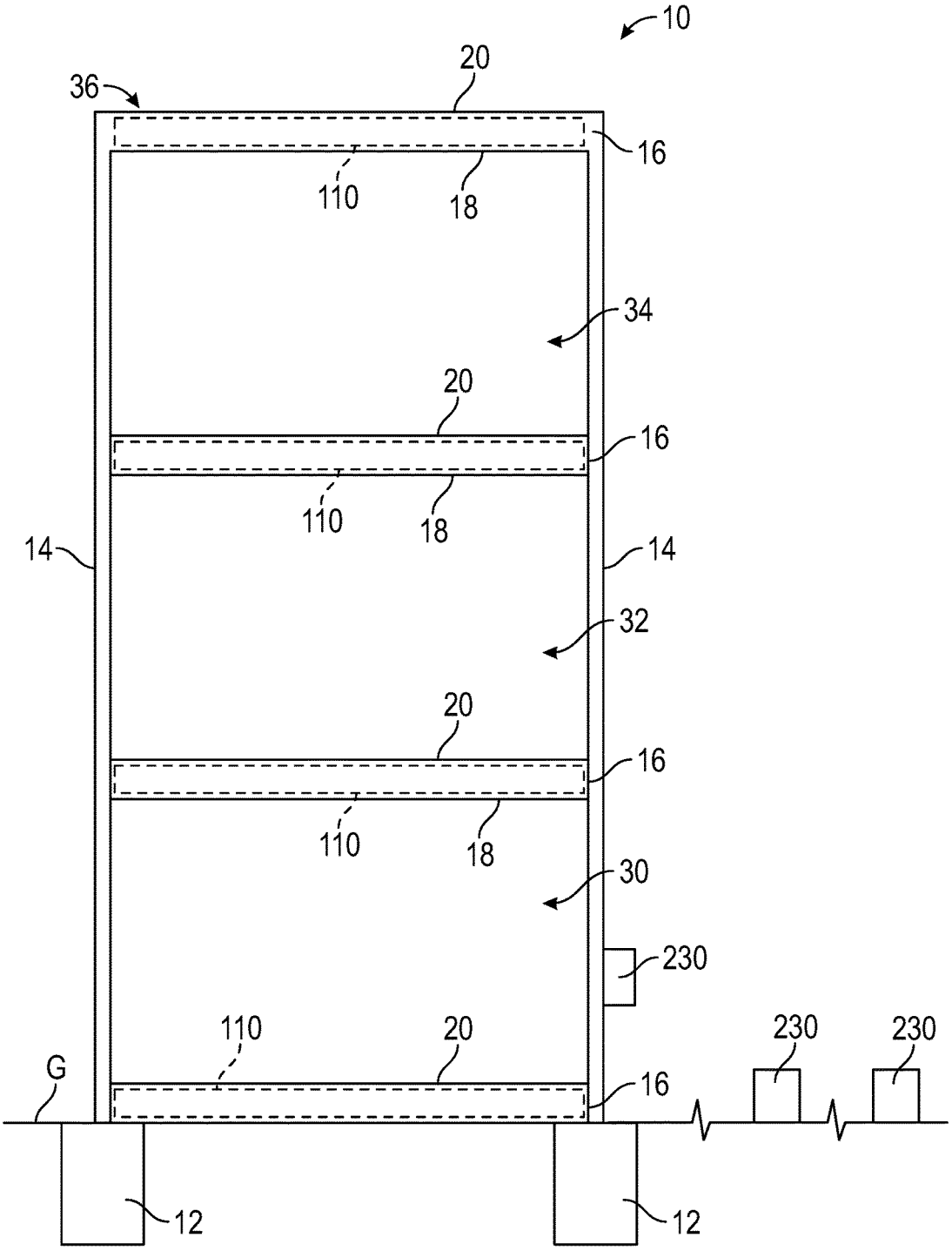
FIG. 1 is a side section view of a building including an earthquake stabilization system, according to an exemplary embodiment.

Referring to FIG. 1, a man-made structure or freestanding structure (e.g., an office building, an apartment building, a home, a low-rise building, a high-rise building, a sky-rise building, a supertall building, etc.), shown as building 10, is shown according to an exemplary embodiment. The building 10 is supported by a support surface, shown as ground G. The building 10 includes a base, shown as foundation 12, that extends into the ground G. The foundation 12 may include steel-reinforced concrete (e.g., concrete with rebar steel reinforcements). In some embodiments, the foundation 12 includes one or more isolators (e.g., rubber sections) configured to reduce the transfer of energy to the building 10 and/or the movement of the building 10 during a seismic event (e.g., an earthquake, an explosion near the building 10, an impact of a meteor near the building 10, etc). In other embodiments, the foundation 12 defines one or more subfloors of the building 10 (i.e., floors beneath the surface of the ground G).

The building 10 further includes one or more vertical or upward supports, structures, or portions, shown as walls 14. The walls 14 extend upward above the ground G. As shown, the walls 14 define exterior surfaces of the building 10. In other embodiments, the building 10 includes one or more interior walls 14 positioned within the building 10 that subdivide the inner volume of the building 10.

The building further includes one or more horizontal supports, structures, or portions (e.g., a floor portion, a ceiling portion, a roof portion, etc.), shown as floor structures 16. The floor structures 16 extend substantially horizontally (e.g., in a substantially horizontal plane) between the walls 14. As shown, each floor structure 16 defines at least one of (a) a ceiling surface 18 on a bottom surface of the floor structure 16 or (b) a floor surface 20 on a top surface of the floor structure 16. The floor structures 16 are configured to support one or more objects or individuals (e.g., furniture, equipment, interior walls, occupants, etc.) in contact with the corresponding floor surface 20.

The walls 14, the ceiling surfaces 18, and/or the floor surfaces 20 define at least one floor (e.g., an occupiable space, an enclosed space, an exposed space, such as a rooftop space, a patio space, etc.) of the building 10. Specifically, as shown in the building 10 of FIG. 1, (a) a first floor or space, shown as ground floor 30, is defined between the walls 14, a ceiling surface 18, and a floor surface 20, (b) a second floor or space, shown as first floor 32, is defined between the walls 14, a ceiling surface 18, and a floor surface 20, (c) a third floor or space, shown as second floor 34, is defined between the walls 14, a ceiling surface 18, and a floor surface 20, and (d) a fourth floor or space, shown as roof 36, is defined above a floor surface 20. Each of the floors is defined by a floor surface 20 and is configured to at least partially contain and support at least one object or individual. In other embodiments, the building 10 includes more or fewer floors. By way of example, the building 10 may include one enclosed floor (e.g., a ground floor). By way of another example, the building 10 may not include an exposed space (e.g., a rooftop space) that is configured to support one or more individuals.

The building 10 is outfitted with a seismic event mitigation system, an earthquake mitigation system, or building stabilization system, shown as earthquake stabilization system 100. The earthquake stabilization system 100 is configured to reduce the energy transferred to the building 10 and/or the movement of the building 10 during a seismic event, thereby mitigating the negative effects of a seismic event on the building 10. By way of example, the earthquake stabilization system 100 may reduce the swaying of the building 10 that would otherwise be caused by seismic waves of a seismic event. Accordingly, the earthquake stabilization system 100 mitigates (e.g., prevents, minimizes, etc.) damage to the building 10, mitigates damage to property within the building 10, and protects individuals within the building 10 during a seismic event.

The earthquake stabilization system 100 includes one or more earthquake stabilization devices, earthquake stabilization assemblies, or weight assemblies, shown as stabilization devices 110. The stabilization devices 110 utilize mobile weights that move along tracks to counteract the effects of seismic waves. In some embodiments, the weights make up 1% to 20% of the weight of the building 10. As shown in FIG. 1, the building 10 is outfitted with four stabilization devices, one within each floor structure 16. The stabilization devices 110 are generally flat and wide to facilitate positioning within the floor structures 16 while minimizing the overall vertical thickness of the floor structure 16. By positioning the stabilization devices 110 within the floor structures 16, the stabilization devices 110 can be hidden from view. In other embodiments, the building 10 includes more or fewer stabilization devices 110. By way of example, one or more floors of the building 10 may not include stabilization devices.

The stabilization devices 110 may have a variety of different positions within a building. In some embodiments, the stabilization devices 110 may be positioned within the foundation 12. In some embodiments, the stabilization 110 may be positioned within floor structures 16 of one or more subfloors. In some embodiments, a building may include more than one stabilization device 110 within a single floor structure. By way of example, the stabilization devices 110 may be stacked atop one another. In such arrangements, each stabilization device 110 may be able to counteract seismic waves coming from different directions or ranges of directions. By way of another example, multiple stabilization devices 110 may be positioned throughout a floor. By using multiple stabilization devices 110, the stabilization devices 110 can be sized and shaped to fit within smaller sections of the building, while the use of multiple stabilization devices 110 maintains the overall efficacy of the system. For example, buildings that are wide in a first direction (e.g., north-south) but narrow in a second direction (e.g., east-west) may benefit from the placement of multiple stabilization devices 110 throughout a single floor structure. Buildings with complex shapes (e.g., L-shaped buildings, U-shaped buildings, S-shaped buildings, I-shaped buildings, etc.) may also benefit from the placement of multiple stabilization devices 110 throughout a single floor structure.

Figure 2:
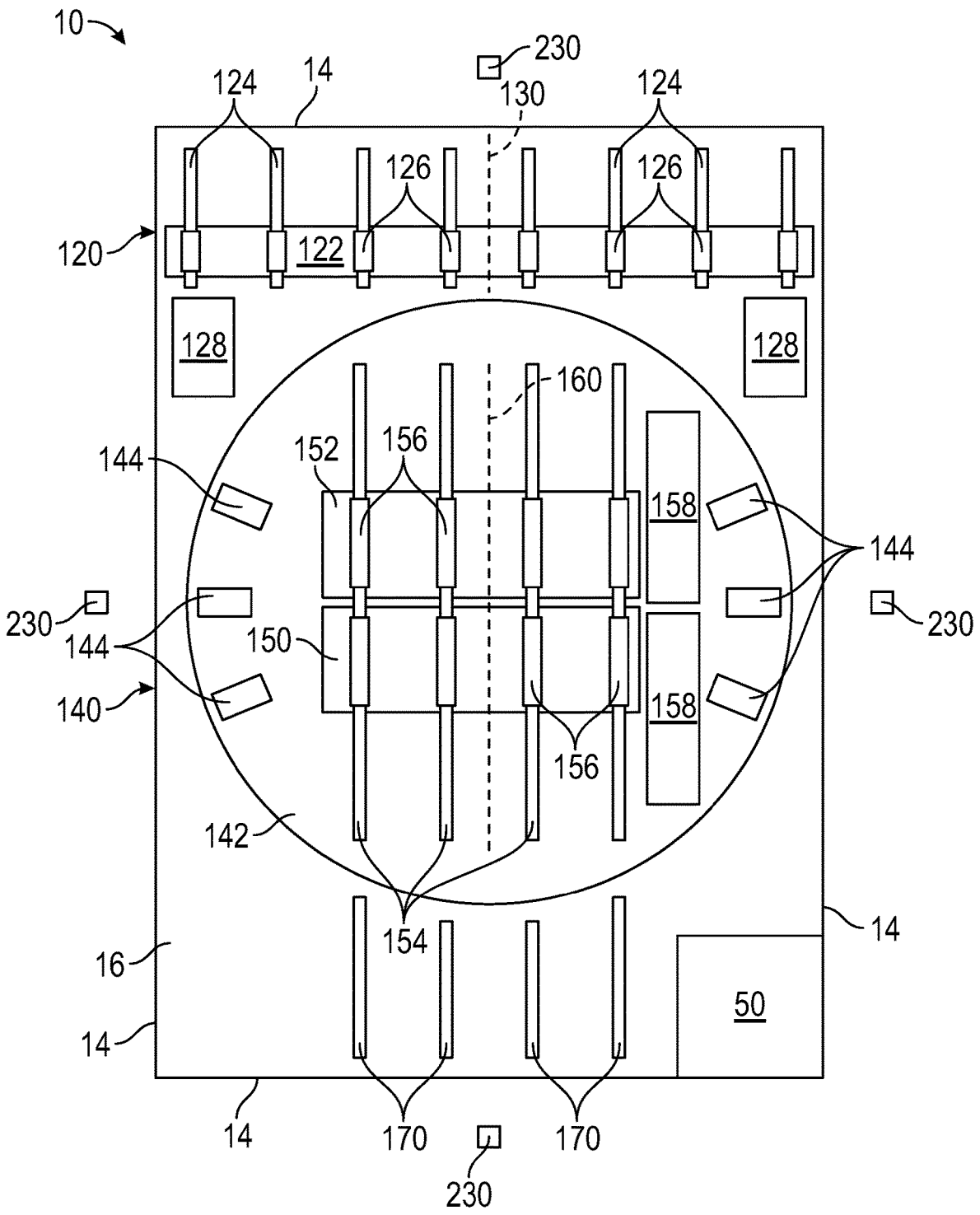
FIG. 2 is a top section view of the building of FIG. 1.

Referring to FIG. 2, a stabilization device 110 is shown within a floor structure 16 of the building 10, according to an exemplary embodiment. In the embodiment of the building 10 shown, a vertical lift, shown as elevator 50, is positioned along the exterior walls 14 of the building (e.g., in a corner of the building 10) to maximize space for the stabilization device 110 without the stabilization device 110 interfering with the path of the elevator 50.

As shown in FIG. 2, the stabilization device 110 includes a first portion, section, or assembly, shown as stationary portion 120. The stationary portion 120 includes a mobile mass or weight (e.g., a sliding weight), shown as weight 122. A series of guides, shown as tracks 124, are fixedly coupled to the floor structure 16. As shown, the tracks 124 each extend longitudinally, parallel to one another. A series of guides (e.g., bushings, bearings, wheel assemblies, etc.), shown as slides 126, are fixedly coupled to the weight 122 and slidably coupled to the tracks 124. Accordingly, the slides 126 slidably couple the weight 122 to the tracks 124. One or more actuators (e.g., electric motors, hydraulic cylinders, etc.), shown as motors 128, are coupled to the floor structure 16 and to the weight 122. When activated, the motors 128 cause the weight 122 to move along a track path 130 defined by the tracks 124. In other embodiments, the motors 128 are coupled to the weight 122 and configured to move along the track path 130 with the weight 122. As shown, the track path 130 extends longitudinally, parallel to the tracks 124. Because the tracks 124 of the stationary portion 120 are fixed relative to the floor structure 16, the track path 130 of the stationary portion 120 is fixed relative to the building 10. As shown, the weight 122 is wider in the lateral direction (i.e., perpendicular to the track path 130) than in the longitudinal direction (i.e., parallel to the track path 130).

As shown in FIG. 2, the stabilization device 110 includes a second portion, section, or assembly, shown as rotating portion 140. The rotating portion 140 includes a base or frame, shown as rotating platform 142, that is rotatably coupled to the floor structure 16. In some embodiments, the rotating platform 142 is configured to rotate about a substantially vertical axis (e.g., less than 360 degrees, more than 360 degrees, etc.). One or more actuators (e.g., electric motors, hydraulic cylinders, etc.), shown as rotation motors 144, are coupled to the floor structure 16 and to the rotating platform 142. When activated, the rotation motors 144 are configured to drive the rotating platform 142 to rotate relative to the floor structure 16. In other embodiments, the rotation motors 144 are directly coupled to the rotating platform 142 and configured to rotate with the rotating platform 142.

The rotating portion 140 further includes a pair of mobile masses, shown as weights 150 and 152. A series of guides, shown as tracks 154, are fixedly coupled to the rotating platform 142. As shown, the tracks 154 each extend within a horizontal plane, parallel to one another. A series of guides (e.g., bushings, bearings, wheel assemblies, etc.), shown as slides 156 are each fixedly coupled to one of the weights 150 and 152 and slidably coupled to the tracks 154. Accordingly, the slides 156 slidably couple the weights 150 and 152 to the tracks 154. One or more actuators (e.g., electric motors, hydraulic cylinders, etc.), shown as motors 158, are coupled to the rotating platform 142. Each motor 158 is at least selectively coupled (e.g., fixedly coupled, selectively coupled with a clutch, etc.) to one of the weights 150 and 152. When activated, the motors 158 cause one or both of the weights 150 and 152 to move along a track path 160 defined by the tracks 154. Specifically, the track path 160 extends longitudinally, parallel to the tracks 154. Because each of the weights 150 and 152 are coupled to a separate motor 158 or group of motors 158, the movement of the weight 150 and the movement of the weight 152 can each be controlled independently. By way of example, the weights 150 and 152 may move in different directions and/or at different speeds. As shown, the weights 150 and 152 are each wider in a direction that extends perpendicular to the track path 160 than in a direction that extends parallel to the track path 160.

The weights described herein (e.g., the weight 122, the weight 150, the weight 152) may be configured to maximize the amount of mass that can fit within the floor structure 16. By way of example, the weights may be made from a relatively dense material, such as lead or steel. The weight may be 1000 lbs, 2000 lbs, 3000 lbs, 5000 lbs, 10000 lbs, etc. The weights may be wide (laterally), while remaining relatively short (vertically) and thin (longitudinally). Such a configuration may minimize the height of the stabilization device while maximizing travel distance of the weights and maximizing mass. By way of example, each weight may be approximately 1 ft high, 3 ft deep, and 12 ft wide. In other embodiments, the weights are otherwise shaped.

The rotating platform 142 facilitates adjustment of the orientation of the track path 160 relative to the building 10. Specifically, the rotation motors 144 may rotate the rotating platform 142, thereby rotating the tracks 154 relative to the building 10. Accordingly, the rotating platform 142 may facilitate protecting the building 10 from seismic waves that travel in a variety of different directions. By way of example, the rotating platform 142 may rotate to align the track path 160 with the direction of the seismic waves.

Referring still to FIG. 2, the stabilization device 110 further includes an additional set of guides or tracks, shown as extension tracks 170. The extension tracks 170 are fixedly coupled to the floor structure 16. The extension tracks 170 are positioned to align with the tracks 154 in at least one orientation of the rotating platform 142 (e.g., one orientation, two orientations offset from one another by 180 degrees, etc.). With the extension tracks 170 aligned with the tracks 154, the weight 150 and/or the weight 152 may be able to move onto the extension tracks 170. Accordingly, the extension tracks 170 may facilitate extending the movement range of the weight 150 and/or the weight 152 in certain orientations of the rotating platform 142. In other embodiments, the stabilization device 110 includes additional extension tracks 170 such that the tracks 154 align with at least one set of extension tracks 170 in multiple orientations of the rotating platform 142.

Figure 3:
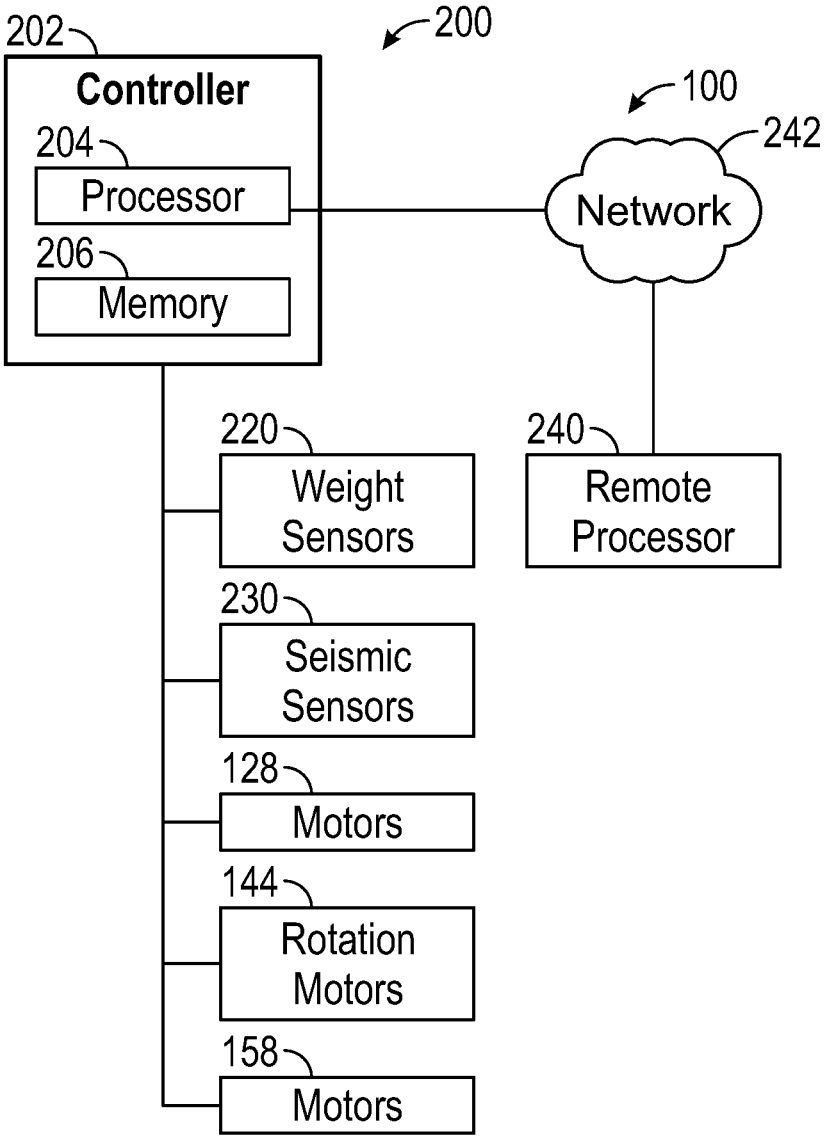
FIG. 3 is a block diagram of a control system of the earthquake stabilization system of FIG. 1.

Referring to FIG. 3, the earthquake stabilization system 100 includes a control system 200 that is configured to control operation of the earthquake stabilization system 100. The control system 200 includes a controller 202. The controller 202 includes a processor 204 and a memory device, shown as memory 206. The memory 206 may contain one or more programs or instructions for execution by the processor 204.

Figure 5:
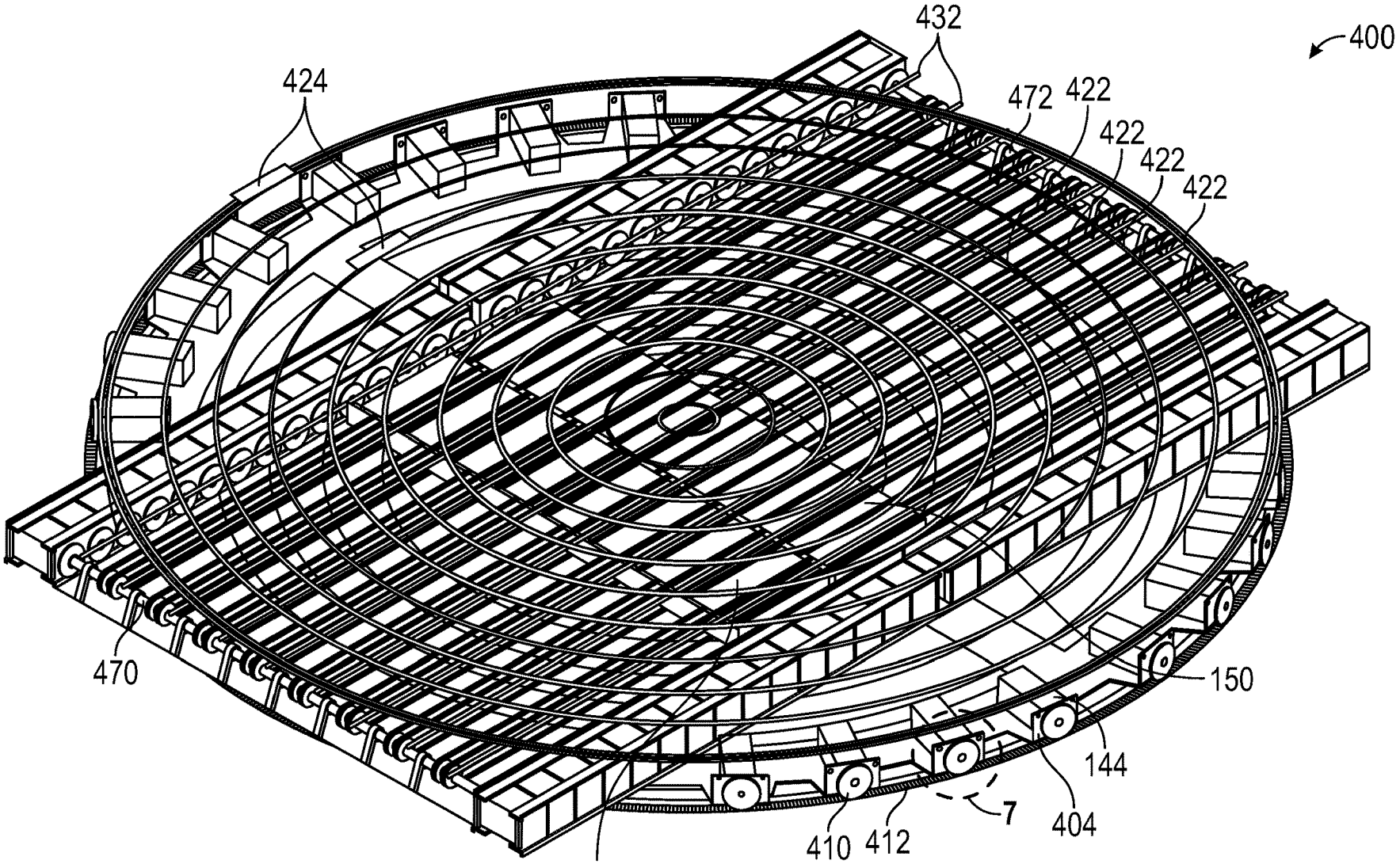
FIGS. 5 and 6 are perspective views of a rotating portion of the earthquake stabilization system of FIG. 1, according to an exemplary embodiment.

As shown in FIG. 5, the controller 202 is operatively coupled to (e.g., in communication with) the motors 128, the rotation motors 144, and the motors 158. The controller 202 may control operation of the motors 128, the rotation motors 144, and the motors 158. By way of example, the controller 202 may control a relay or other motor controller to supply electrical energy to the motors to drive the motors and/or to cause the motors to impart a braking force. By way of another example, in embodiments that utilize hydraulic actuators (e.g., hydraulic cylinders), the controller 202 may control one or more pumps and/or valves to vary the flow of hydraulic to and/or from the actuators.

In some embodiments, the controller 202 includes one or more sensors, shown as weight sensors 220, that each measure operation of a stabilization device 110. In some such embodiments, the weight sensors 220 are configured to measure movement of one or more of the weights of a stabilization device 110 (e.g., the weight 122, the weight 150, the weight 152). The weight sensors 220 may measure (e.g., directly or indirectly) position (e.g., a relative position, an absolute position), speed, acceleration, movement direction, or another aspect of movement of a weight. The weight sensors 220 may each include a potentiometer, an optical encoder, an accelerometer, a gyroscope, a limit switch (e.g., positioned to be contacted by the weight when the weight reaches a predetermined position, etc.), or another type of sensor. The weight sensors 220 may be directly coupled to one of the weights. By way of example, a weight sensor 220 may include an accelerometer that is directly coupled to the weight and configured to measure an acceleration of the weight. Using the acceleration data from the weight sensor 220, the controller 202 may determine the speed and/or position of the weight. Additionally or alternatively, the weight sensors 220 may be indirectly coupled to the weights (e.g., coupled to another component that moves with the weight). By way of example, a weight sensor 220 may include an optical encoder be coupled to an output of a motor 158. The controller 202 may store a predetermined relationship between the rotation of the output of the motor 158 and the resultant position of the weight 150. Accordingly, the controller 202 may measure the output of the optical encoder over time (e.g., which may indicate the rotational position of the output) and determine the position, speed, and/or acceleration of the weight 150.

In some embodiments, the weight sensors 220 are configured to measure movement of one or more of the rotating platforms 142. By way of example, the weight sensors 220 may measure (e.g., directly or indirectly) orientation (e.g., an orientation of the rotating platform 142 relative to the floor structure 16, an absolute orientation of the rotating platform 142), speed, acceleration, movement direction, or another aspect of movement of a rotating platform 142. By way of example, a weight sensor 220 may include a potentiometer that is rotationally engaged with the rotating platform 142 to provide the orientation of the rotating platform 142. By way of another example, a gyroscope may be coupled to the rotating platform 142.

In some embodiments, the controller 202 uses the data from the weight sensors 220 to perform closed loop control over the movement of the weights and/or the rotating platform 142. By way of example, the controller 202 may determine a desired orientation of the rotating platform 142 and use feedback from a weight sensor 220 (e.g., data indicating a current orientation of the rotating platform 142) to determine control signals that cause the rotation motors 144 to drive the rotating platform 142 to the desired orientation. By way of another example, the controller 202 may determine a desired acceleration curve (e.g., a desired acceleration over time) of the weight 150 and use feedback from a weight sensor 220 (e.g., data indicating the current acceleration of the weight 150) to determine control signals that cause the motors 158 to drive the weight 150 to meet the desired acceleration curve.

In some embodiments, the controller 202 uses the data from the weight sensors 220 to determine operational limits for control over the movement of the weights and/or the rotating platform 142. By way of example, the controller 202 may set predetermined limits for the position and/or orientation of each weight and/or the rotating platform 142.

Such limits may prevent the controller 202 from attempting to drive the weights and/or the rotating platform 142 beyond a physical limit (e.g., a position beyond which the weight 150 would be driven off of the track 154). By way of another example, the controller 202 may set a predetermined limit for the acceleration of each weight and/or the rotating platform 142. Such limits may limit the forces experienced by the stabilization device 110.

In some embodiments, the weight sensors 220 are configured to measure a temperature within the stabilization devices 110. By way of example, the weight sensor 220 may include a temperature sensor configured to measure a temperature of one or more of the weight 122, the tracks 124, the slides 126, the motors 128, the rotating platform 142, the rotation motors 144, the weight 150, the weight 152, the tracks 154, the slides 156, or the motors 158. In some embodiments, the controller 202 controls operation of one or more of the stabilization devices 110 based on the temperature data from the weight sensors 220. By way of example, the controller 202 may limit (e.g., prevent) operation of one of the motors 158 if a temperature of a corresponding component (e.g., a weight 150, a weight 152, a track 154, a slide 156, the motor 158 itself) exceeds a predetermined temperature.

Referring to FIGS. 1-3, the control system 200 further includes one or more seismic measurement sensors, shown as seismic sensors 230, operatively coupled to the controller 202. The seismic sensors 230 are configured to measure seismic activity at or near the building 10 (e.g., provide information characterizing a seismic event). By way of example, the seismic sensors 230 may measure or otherwise provide information related to the speed, magnitude, or direction of a seismic wave. In some embodiments, the seismic sensors 230 may include an accelerometer or seismograph.

The earthquake stabilization system 100 may include one or multiple seismic sensors 230. The seismic sensors 230 may be positioned at the building 10 or separated a distance from the building 10. The earthquake stabilization system 100 may include multiple seismic sensors 230 positioned at different distances from the building 10. For example, in the embodiment shown in FIG. 1, the earthquake stabilization system 100 includes one seismic sensor 230 positioned at the building 10 (e.g., coupled directly to the building 10), one seismic sensor 230 positioned at a first distance (e.g., 1 mile, 10 miles, 50 miles, 100 miles, etc.) from the building 10, and another seismic sensor 230 positioned at a second distance from the building 10, where the second distance is greater than the first distance. Additionally or alternatively, the earthquake stabilization system 100 may include multiple seismic sensors 230 positioned at different angular positions relative to the building 10. In the embodiment shown in FIG. 2, the earthquake stabilization system 100 includes four seismic sensors 230, each angularly offset approximately 90 degrees from one another. In some embodiments, the earthquake stabilization system 100 services multiple buildings 10, and the sensor data from the seismic sensors 230 is shared between each of the buildings 10.

Referring to FIG. 3, the control system 200 includes an additional controller, shown as remote processor 240. By way of example, the remote processor 240 may include a controller (e.g., a server) positioned outside of the building 10. By way of another example, the remote processor 240 may be positioned within a different area of the building 10 from the controller 202. The remote processor 240 is operatively coupled to the controller 202 through a network 242 (e.g., a wired network, a wireless network, a local area network, the Internet, etc.). The remote processor 240 may handle any of the information processing and/or information storage described herein as being performed by the controller 202. By way of example, the remote processor 240 may be server than handles the processing of information for an earthquake stabilization system 100 that serves multiple buildings 10. In other embodiments, the remote processor 240 is omitted and the controller 202 handles all of the processing of the earthquake stabilization system 100.

Figure 4:
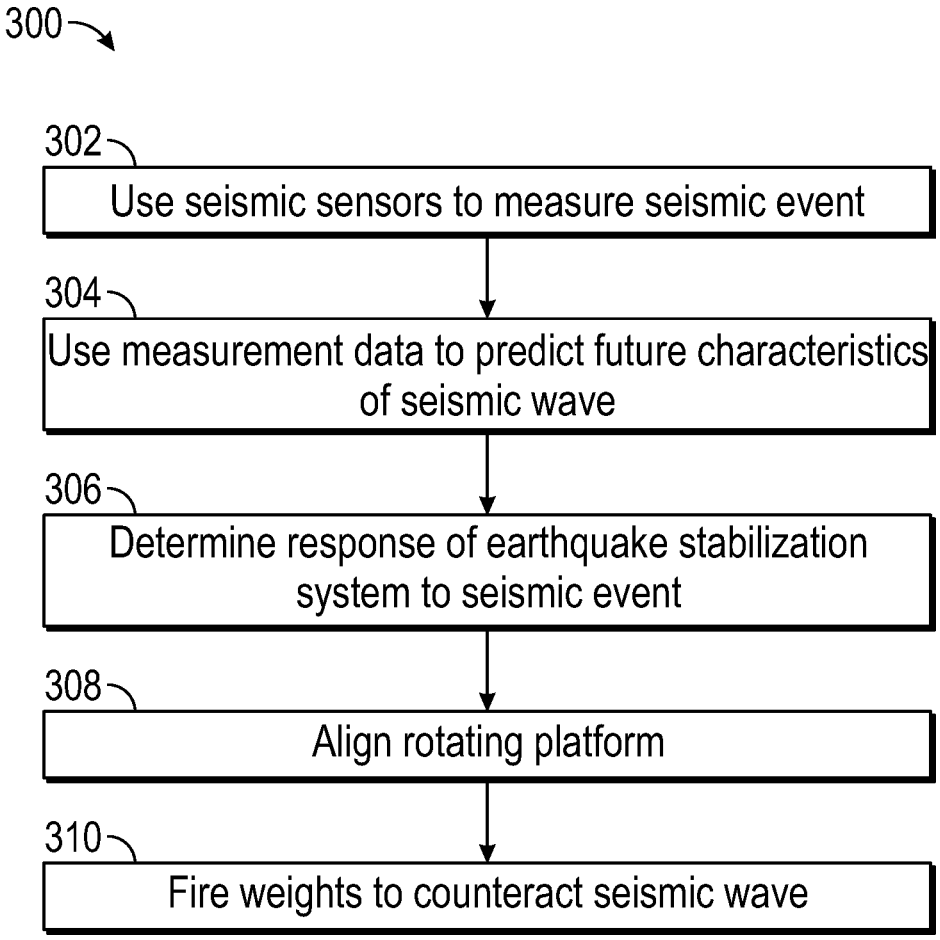
FIG. 4 is a block diagram of a method for operating the earthquake stabilization system of FIG. 1.

Referring to FIG. 4, a method 300 for operating the earthquake stabilization system 100 to mitigate the effect of a seismic event is shown according to an exemplary embodiment. In step 302 of the method 300, the controller 202 controls the seismic sensors 230 to measure a seismic event. The seismic sensors 230 may be in constant or periodic communication with the controller 202. Additionally or alternatively, the seismic sensors 230 may initiate communication with the controller 202 in response to receiving a measurement indicative of a seismic event. The seismic sensors 230 may measure various characteristics of a seismic wave, such as intensity, amplitude, frequency, or direction. The location of each seismic sensor 230 (e.g., relative to the building 10) may be predetermined and stored in the memory 206. Accordingly, the controller 202 may associate the measurement data of each seismic sensor 230 with the location of the corresponding seismic sensor 230. Additionally or alternatively, the controller 202 may associate the measurement data with a corresponding time when the measurement occurred. The controller 202 may control the seismic sensors 230 to generate measurement data (e.g., ten times per second, once every second, once every ten seconds, etc.).

In step 304 of the method 300, the controller 202 uses the measurement data to predict future characteristics (i.e., predicted data) of the seismic event (e.g., future characteristics of a specific seismic wave). By way of example, in a system that includes multiple seismic sensors 230 at different distances from the building 10 (e.g., as shown in FIG. 1), the controller 202 may use the predetermined positions of the seismic sensors 230 and the times at which the seismic sensors 230 detected the seismic wave to predict when the seismic wave will reach the building 10. By way of another example, the controller 202 may use the predetermined positions of one or more of the seismic sensors 230 and the characteristics (e.g., intensity, amplitude, frequency, etc.) of the seismic wave measured by the seismic sensors 230 to predict the characteristics of the seismic wave when the seismic wave reaches the building 10. By way of another example, in a system including multiple seismic sensors 230 at different angular positions, the controller 202 may predict the path the seismic wave. Based on the predicted path, the controller 202 may predict the direction of the seismic wave when it reaches the building 10. By way of example, the controller 202 may determine the path of the seismic wave based on the relative intensities measured by each seismic sensor 230 as the seismic wave moves toward the building 10.

In step 306 of the method 300, the controller 202 determines the response of the earthquake stabilization system 100 to the seismic event (e.g., a target response of the stabilization devices 110 which the controller 202 seeks to control the stabilization devices 110 to produce). The controller 202 may seek to optimize the target response to most effectively mitigate the effect of the seismic event on the building 10. The relationships between the measurement data, the predicted data, and the target response may be predetermined and stored in the memory 206. By way of example, the relationship may be a formula. The relationship may be generated based on characteristics of the building 10 (e.g., the dimensions of the building 10, the materials used in the building 10, the number of floors in the building 10, the type of foundation 12, the type of soil supporting the building 10, the location of the building 10, the wind exposure of the building 10, etc.). The relationship may be generated based on characteristics of the earthquake stabilization system 100 (e.g., the number of stabilization devices 110, the locations of the stabilization devices 110 within the building 10, the mass of each weight (e.g., the weight 122, the weight 150, the weight 152), the power output of each motor (e.g., a torque/speed curve of an electric motor, the output force and/or speed of a hydraulic cylinder, etc.), the travel of each weight (i.e., the range of locations through which each weight can move), etc.).

As part of the target response, the controller 202 may independently or collectively control one or more functions of the stabilization devices 110. By way of example, the controller 202 may control the position, speed, acceleration, and/or movement direction of the weight 122, the weight 150, and/or the weight 152 (e.g., by controlling the motor 128 and/or the motors 158). The controller 202 may control the rotational position, speed, acceleration, and/or movement direction of the rotating platform 142. The controller 202 may independently or collectively control the operation of each stabilization device 110. By way of example, the controller 202 may control one stabilization device 110 to move while controlling another stabilization device 110 to stay stationary. By way of another example, the controller 202 may control two or more stabilization devices 110 to move simultaneously.

In step 308 of the method 300, the controller 202 aligns the rotating platform 142 according to the target response. Specifically, the controller 202 controls the rotation motors 144 to move the rotating platform 142 (and thus the tracks 154 and the track path 160) to a target orientation specified by the target response. The target orientation may align the track path 160 with the movement direction of the seismic wave (e.g., as measured in step 302 or predicted in step 304). The target orientation may place the weight 150 and/or the weight 152 in a position that facilitates firing the weight 150 and/or 152 according to the target response. By way of example, the target response may require that the weight 150 and the weight 152 move toward a south side of the building 10. To facilitate this, the weight 150 and the weight 152 may be located near a first end of the tracks 154 while the stabilization device 110 is not in use. The controller 202 may then rotate the rotating platform 142 such that the weight 150 and the weight 152 are rotated away from the south side of the building (e.g., the track path 160 faces north-south and the weight 150 and the weight 152 are positioned as far north as the tracks 154 will permit). By storing the weight 150 and the weight 152 in this manner, the available travel distance of the weight 150 and the weight 152 is maximized.

In step 310 of the method 300, the controller 202 fires (i.e., moves along the respective tracks) the weights (e.g., the weight 122, the weight 150, and/or the weight 152) to counteract the seismic wave. Specifically, the controller 202 controls the motor 128 and/or the motors 158 to fire one or more of the weights to counteract the seismic wave according to the target response. The timing, direction, speed, and/or acceleration of each weight in the target response may be based on the characteristics of the seismic wave. By way of example, the controller 202 may control one or more motors to fire the weights when the seismic wave is predicted (e.g., in step 304) to reach the building 10. By way of another example, if a seismic wave is predicted (e.g., in step 304) to move the bottom of the building 10 in a first direction, the controller 202 may control one or motors to move one or more weights in a second direction opposite the first direction relative to the building 10. The relatively large inertias of the weights (e.g., due to the relatively large masses of the weights) resist this motion. Accordingly, the forces of the motors cause the building to move in the first direction. This causes the top portion of the building 10 to move in the same direction as the bottom portion of the building 10, which minimizes the bending of the building 10, thereby minimizing stresses on the building 10. In some embodiments, the controller 202 causes the stabilization devices 110 of lower floors to exert different (e.g., lesser) forces than the stabilization devices 110 of higher floors, as the lower floors have less potential to sway. By way of another example, the controller 202 may vary the forces exerted on the weights by the motors based on the intensity of the seismic wave (e.g., as measured in step 302 or predicted in step 304). For example, the controller 202 may utilize greater forces to counteract seismic waves of greater intensity. In some embodiments, steps 308 and 310 occur simultaneously, such that the rotating platform 142 is rotated while the weights are fired.

In some embodiments, the controller 202 may reset the position of the weights to facilitate subsequent firings. By way of example, the controller 202 may control one or more motors to move one or more weights along the track to a position that facilitates subsequent firings outlined in the target response. The controller 202 may utilize lesser speeds and/or accelerations when resetting the weights than when firing the weights in order to minimize any unintentional movement of the building 10 caused by resetting the weights. By way of another example, the controller 202 may rotate the rotating platform 142 (e.g., by 180 degrees) to reset the positions of one or more weights. In other embodiments, the controller 202 fires the weights in opposing directions, such that the weights reciprocate to counteract repeated movement in opposing directions. After completing step 310, the controller 202 may repeat any of steps 302-310 as necessary to counteract any subsequent seismic waves until the seismic event has subsided.

Referring to FIGS. 5-9, a rotating portion 400 is shown according to an exemplary embodiment. Specifically, the rotating portion 400 is an exemplary embodiment of the rotating portion 140. The rotating portion 400 may be substantially similar to the rotating portion 140, except as otherwise specified herein. The rotating portion 400 includes a rotating platform 142 including a flat plate, shown as base 402, and a series of flanges or protrusions, shown as motor mounts 404. The motor mounts 404 are fixedly coupled to the base 402 and extend upward from the base 402. As shown, the motor mounts 404 are positioned along a circumference of the base 402 and oriented substantially tangent to the circumference of the base 402.

Figure 6:
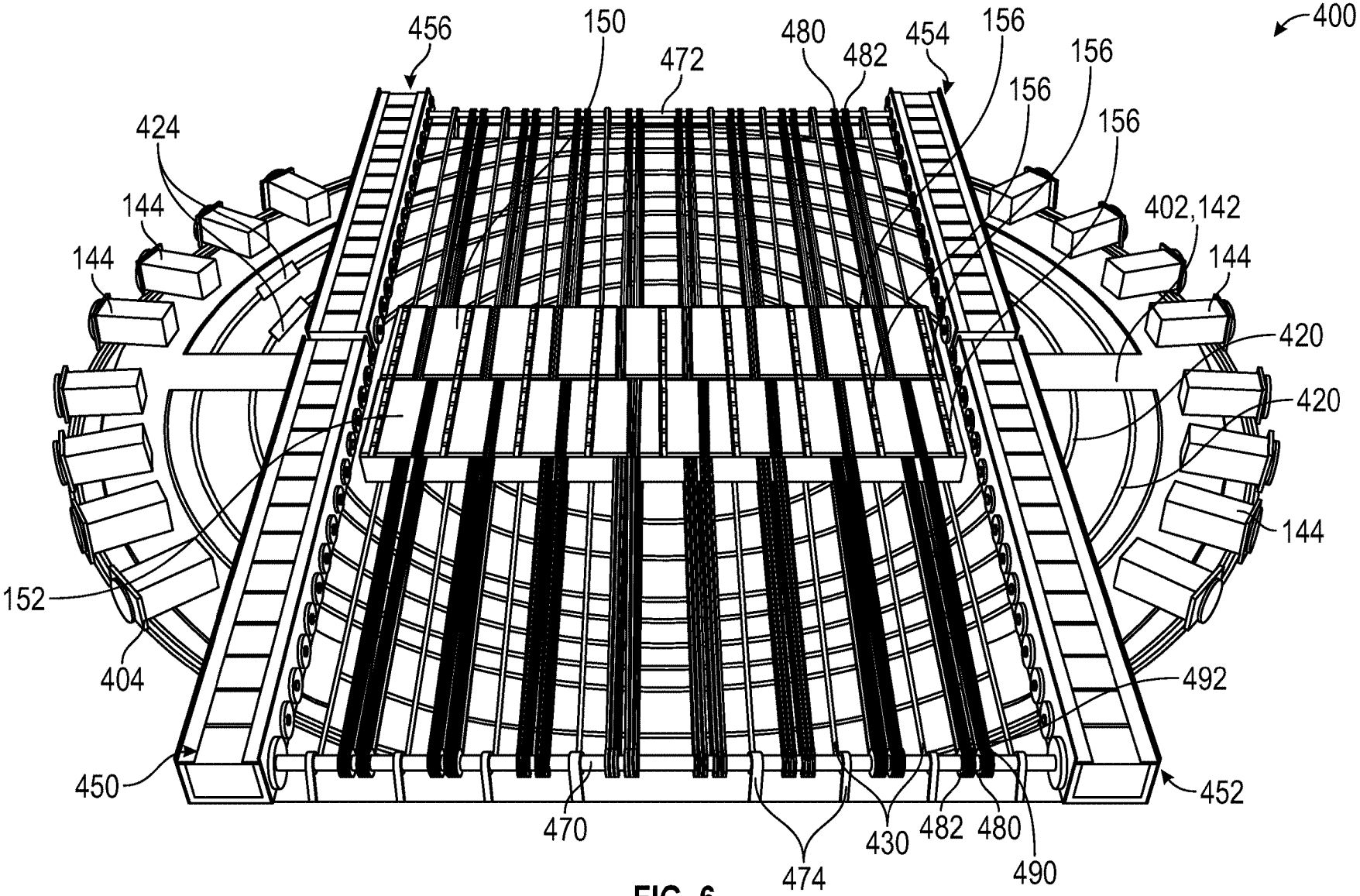

As shown in FIGS. 5 and 6, the rotating portion 400 includes eight rotation motors 144 positioned along the circumference of the base 402. In other embodiments, the rotating portion 400 includes more or fewer than eight rotation motors 144. In some embodiments, each rotation motor 144 provides approximately 1500 kW of output power. Each rotation motor 144 includes a motor body 406 and an output, shown as output shaft 408. A front face of each motor body 406 is fixedly coupled to a motor mount 404. Each output shaft 408 extends radially outward from the corresponding motor body 406. Due to the tangent orientation of each motor mount 404, each output shaft 408 is substantially aligned with a center of the rotating portion 400. Each output shaft 408 is coupled to a driving wheel (e.g., a spur gear), shown as gear 410. An annular rack gear 412 is positioned below each of the gears 410. The annular rack gear 412 is circular and centered about the axis of rotation of the rotating portion 400. In embodiments where the rotating portion 400 rotates less than 360 degrees, the annular rack gear 412 may form less than full circle (e.g., a half circle, 270 degrees of a circle, etc.). The annular rack gear 412 is fixedly coupled to the floor structure 16. Each of the gears 410 is in meshing engagement with the annular rack gear 412 such that gears 410 couple the output shafts 408 to the annular rack gear 412. Accordingly, when the rotation motors 144 are driven, the output shafts 408 rotate the gears 410 that engage the annular rack gear 412, causing the rotating platform 142 to rotate relative to the floor structure 16.

Referring to FIGS. 5 and 6, the rotating portion 400 includes a series of rotational couplers, guides, rails, or tracks, shown as bottom tracks 420 and top tracks 422. The bottom tracks 420 are positioned within a substantially horizontal plane extending along a bottom side of the rotating portion 400, and the top tracks 422 are positioned within a substantially horizontal plane extending along a top side of the rotating portion 400. The bottom tracks 420 and the top tracks 422 each include a series of annual, concentric tracks of a variety of different radii. In some embodiments, the bottom tracks 420 and the top tracks 422 are each centered about the axis of rotation of the rotating portion 400. In some embodiments, the bottom tracks 420 and the top tracks 422 are evenly distributed to facilitate distribution of the weight of the rotating portion 400 across multiple tracks. By way of example, each adjacent track may increase in size by a fixed radius (e.g., 2 feet, 4 feet, etc.). The bottom tracks 420 and the top tracks 422 each engage at least one slide 424 (e.g., a bearing assembly, a bushing assembly, a guide, etc.). Specifically, the slides 424 are each slidably coupled to a bottom track 420 or a top track 422 and configured to move along a circular track path defined by the corresponding bottom track 420 or top track 422. Together, the bottom tracks 420, the top tracks 422, and the slides 424 rotatably couple the rotating portion 400 to the floor structure 16. In some embodiments, the bottom tracks 420 and/or the top tracks 422 are fixedly coupled to the rotating platform 142, and some or all of the slides 424 are fixedly coupled to the floor structure 16. In other embodiments, the bottom tracks 420 and/or the top tracks 422 are fixedly coupled to the floor structure 16, and some or all of the slides 424 are fixedly coupled to the rotating platform 142.

The tracks 154 of the rotating portion 400 include bottom tracks 430 and top tracks 432. The bottom tracks 430 are positioned within a substantially horizontal plane extending along a bottom side of the rotating portion 400, and the top tracks 432 are positioned within a substantially horizontal plane extending along a top side of the rotating portion 400. In some embodiments, the bottom tracks 430 are directly and fixedly coupled to the bottom tracks 420, and the top tracks 432 are directly and fixedly coupled to the top tracks 422. The bottom tracks 430 and the top tracks 432 each extend substantially and parallel to one another. In some embodiments, the bottom tracks 430 and the top tracks 432 are evenly distributed to facilitate distribution of the weight of the weights 150 and 152 across multiple tracks. By way of example, pair of adjacent tracks may be offset from one another by a predetermined distance (e.g., 2 feet, 4 feet, etc.). As shown, a first set of slides 156 is positioned along a top side of each of the weights 150 and 152. This set of slides 156 includes at least one slide 156 engaging each of the top tracks 432 to slidably couple the weights 150 and 152 to the top tracks 432. Similarly, a second set of slides 156 is positioned along a bottom side of each of the weights 150 and 152. This second set of slides 156 includes at least one slide engaging each of the bottom tracks 430 to slidably couple the weights 150 and 152 to the bottom tracks 430.

Figure 8:
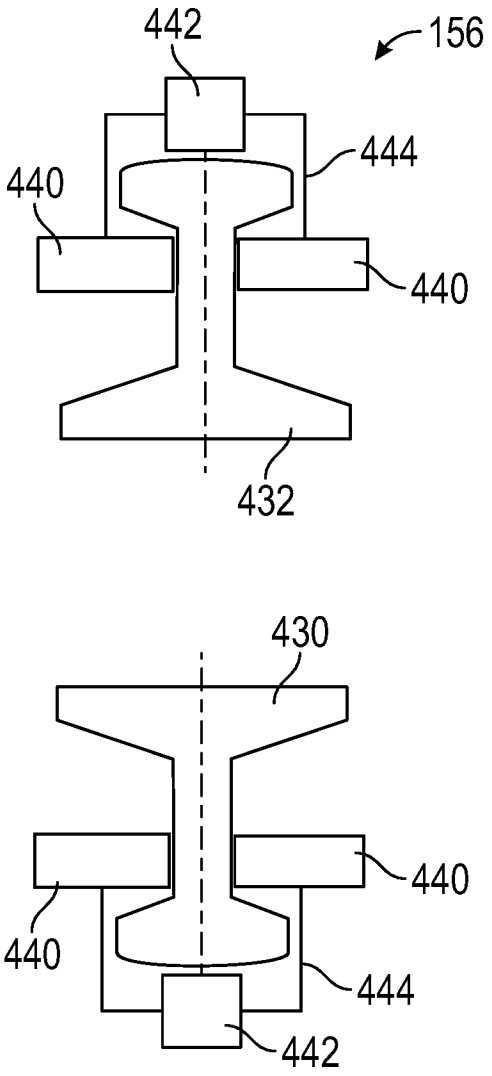
FIG. 8 is a section view of a pair of tracks of the rotating portion of FIG. 5.
Figure 7:
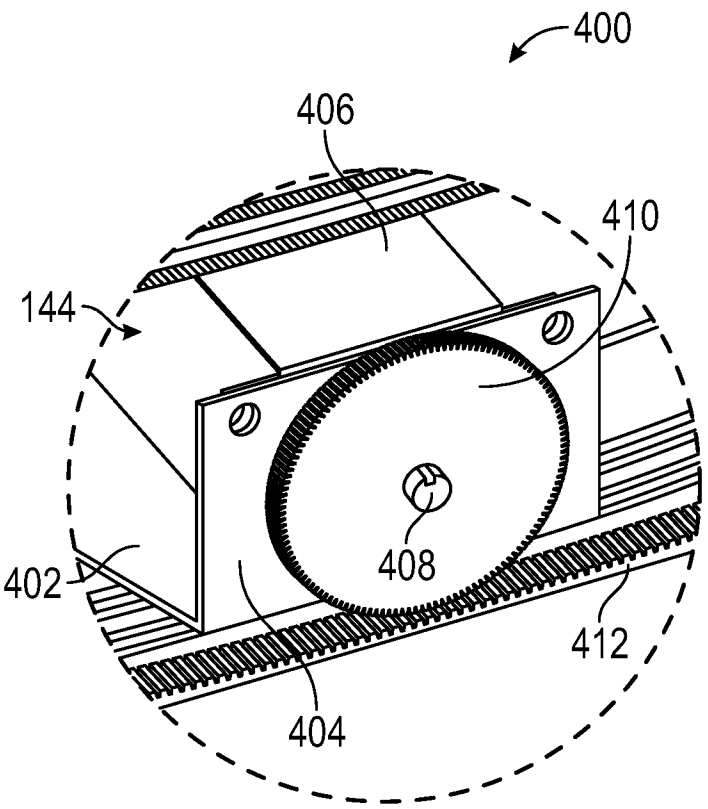
FIG. 7 is a detail view of the rotating portion of FIG. 5.

FIG. 8 illustrates an arrangement of the bottom track 430, the top track 432, and a pair of corresponding slides 156, according to an exemplary embodiment. Although the bottom track 430, the top track 432, and the slide 156 are shown, the bottom tracks 420, the top track 422, and the slides 424 may utilize a similar arrangement. In the arrangement of FIG. 8, the bottom track 430 and top track 432 each have an ASCE rail cross-section (e.g., an ASCE 60 rail cross-section). Each of the slides 156 includes a series of bearings or wheels, including a pair of first wheels, shown as side wheels 440, and a second wheel, shown as wheel 442. The side wheels 440 and the wheel 442 are each rotatably coupled to a frame, shown as slide frame 444. The side wheels 440 each engage opposite lateral side surfaces of the corresponding track and limit lateral movement of the slide 156 relative to the corresponding track. The wheels 442 engage a top surface of the top track 432 and a bottom surface of the bottom track 430. Together, the wheels 442 limit vertical movement of the slides 156 relative to the tracks. Accordingly, the slides 156, the bottom track 430, and the top track 432 provide a low-friction system for guiding the movement of the weight 150 and the weight 152.

In other embodiments, the tracks described herein (e.g., the tracks 124, the track 154, the bottom tracks 420, the top tracks 422, the bottom tracks 430, the top tracks 432, etc.) are otherwise configured. By way of example, tracks that are shown as straight may be curved, and tracks that are shown as curved may be straight. The shape of each track may be variable. By way of example, a track may be flexible, and an actuator may bend the track into a different shape (e.g., vertically, within a horizontal plane, etc.). The tracks may be positioned along a top side, a bottom side, a left side, and/or a right side of any of the weights described herein. Each weight may move along an entire length of the corresponding track or only a certain portion (e.g., a first 30%, a middle 30%, a last 30%, etc.) of the track.

Figure 9:
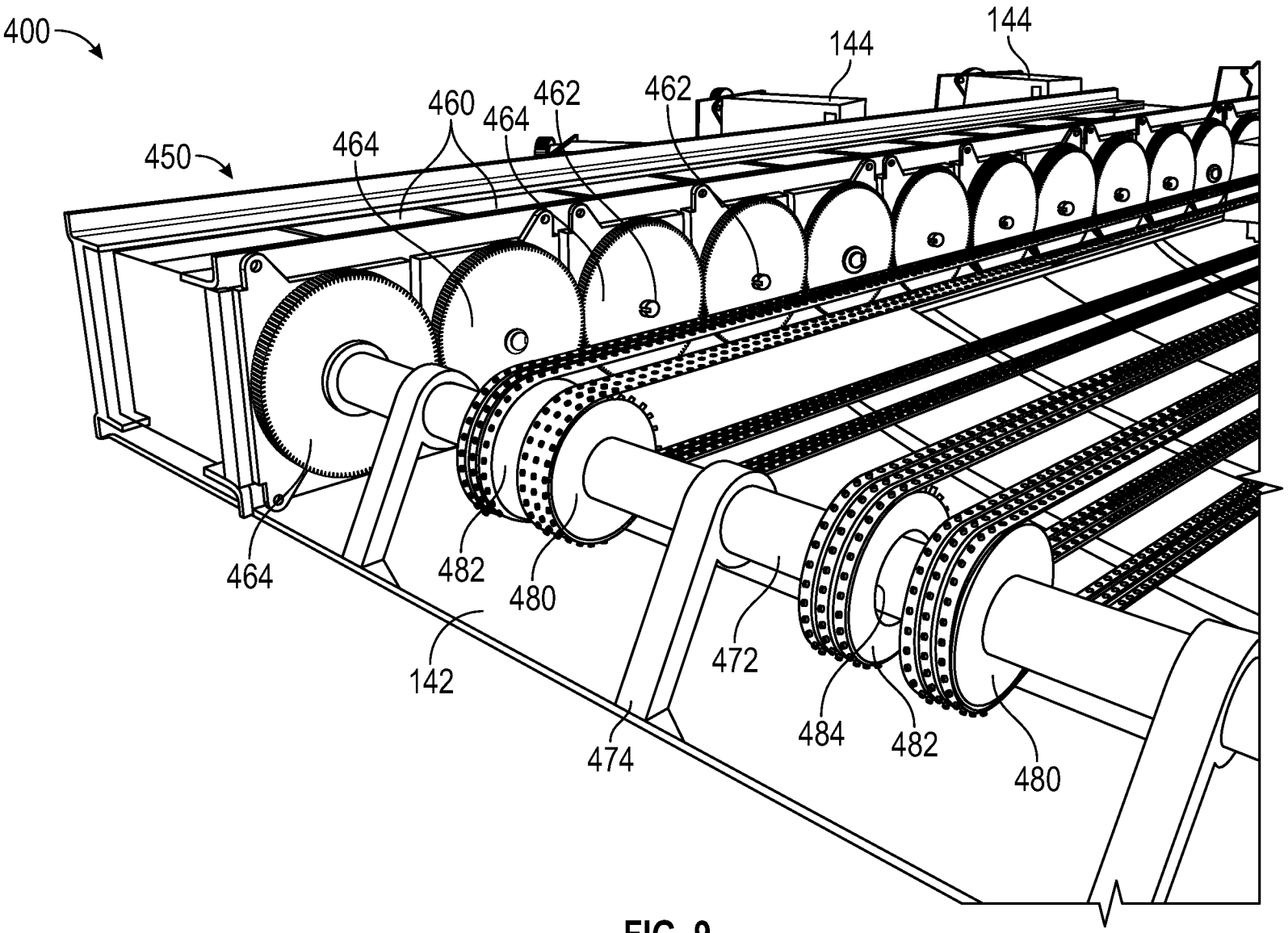
FIG. 9 is another perspective view of the rotating portion of FIG. 5.

Referring to FIGS. 5, 6, and 9, the motors 158 of the rotating portion are arranged in groups or assemblies, shown as motor bank 450, motor bank 452, motor bank 454, and motor bank 456. In some embodiments, each of the motors 158 has an output power of approximately 2700 kW. In some embodiments, the rotating portion 400 includes at least 48 motors. Each of the motors 158 includes a motor body 460 and an output, shown as output shaft 462. The motor bodies 460 are fixedly coupled to the rotating platform 142. The output shafts 462 of the motors 158 are each coupled to a spur gear, shown as gear 464. The gears 464 corresponding to each motor bank engage one another to form a gear train. The gear train transfers the output power between the motors 158 of a given motor bank and causes the output shafts 462 of a motor bank to all move at the same speed. As shown, a gear 464 of the motor bank 450 and a gear 464 of the motor bank 452 are each fixedly coupled to a rod or output shaft, shown as drive shaft 470. The drive shaft 470 couples the gear train of the motor bank 450 and the gear train of the motor bank 452. Accordingly, the motors 158 of the motor bank 450 and the motors 158 of the motor bank 452 all provide power to drive the drive shaft 470. A gear 464 of the motor bank 454 and a gear 464 of the motor bank 456 are each fixedly coupled to a rod or output shaft, shown as drive shaft 472. The drive shaft 472 couples the gear train of the motor bank 454 and the gear train of the motor bank 456. Accordingly, the motors 158 of the motor bank 454 and the motors 158 of the motor bank 456 all provide power to drive the drive shaft 470. The drive shaft 470 and the drive shaft 472 are each rotatably coupled to the rotating platform 142 by a series of supports 474.

As shown in FIG. 9, a series of driving wheels (e.g., pulleys, sprockets, winch drums, etc.), shown as drive sprockets 480, and a series of idler wheels (e.g., pulleys, sprockets, winch drums, etc.), shown as idler sprockets 482, are arranged along a length of the drive shaft 470. Specifically, the drive shaft 470 extends from a gear 464, through the supports 474, the drive sprockets 480, and the idler sprockets 482, to another gear 464. The drive sprockets 480 are fixedly coupled (e.g., welded, fastened, etc.) to the drive shaft 470. Each of the idler sprockets 482 includes a bearing 484 that rotatably couples the idler sprocket 482 to the drive shaft 470, permitting the idler sprocket 482 to rotate freely relative to the drive shaft 470. A series of drive sprockets 480 and idler sprockets 482 form a similar arrangement on the drive shaft 472.

A series of first tensile members (e.g., ropes, cables, belts, roller chains, etc.), shown as chains 490, couple the weight 150 to the drive shaft 470. Specifically, each chain 490 is fixedly coupled to the weight 150. Each chain 490 extends from the weight 150, extends around and engages one of the drive sprockets 480 that is fixedly coupled to the drive shaft 470, extends around one of the idler sprockets 482 that is rotatably coupled to the drive shaft 472, and returns to the weight 150. Accordingly, when the motor bank 450 and the motor bank 452 drive the drive shaft 470, the drive sprockets 480 apply a tensile force on the corresponding chains 490, causing the weight 150 to move along the track path 130. The idler sprockets 482 permit free movement of the chains 490 independent of the movement of the drive shaft 472. The drive shaft 470 can be driven in the opposite direction to apply a braking force on the weight 150 and/or to drive the weight 150 in the opposite direction.

A series of second tensile members (e.g., ropes, cables, belts, roller chains, etc.), shown as chains 492, couple the weight 152 to the drive shaft 470. Specifically, each chain 492 is fixedly coupled to the weight 152. Each chain 492 extends from the weight 152, extends around and engages one of the drive sprockets 480 that is fixedly coupled to the drive shaft 472, extends around one of the idler sprockets 482 that is rotatably coupled to the drive shaft 470, and returns to the weight 152. Accordingly, when the motor bank 454 and the motor bank 456 drive the drive shaft 472, the drive sprockets 480 apply a tensile force on the corresponding chains 492, causing the weight 152 to move along the track path 130. The idler sprockets 482 permit free movement of the chain 492 independent of the movement of the drive shaft 470. The drive shaft 472 can be driven in the opposite direction to apply a braking force on the weight 152 and/or to drive the weight 152 in the opposite direction.

Referring to FIG. 6, each of the weights 150 and 152 define a series of recesses or passages, shown as clearance passages 494. The clearance passages 494 each extend longitudinally through the corresponding weight, from a front face of the weight to a rear face of the weight. The clearance passages 494 provide clearance for the chains 490 and 492 to prevent interference. Specifically, the clearance passages 494 of the weight 150 are aligned with the chains 492 such that the chains 492 pass through the clearance passages 494 of the weight 150. Accordingly, the chains 492 can move freely through the weight 150, independent of the movement of the weight 150. Similarly, the clearance passages 494 of the weight 152 are aligned with the chains 490 such that the chains 490 pass through the clearance passages 494 of the weight 152. Accordingly, the chains 490 can move freely through the weight 152, independent of the movement of the weight 152.

As shown in FIGS. 5 and 6, the motor banks 450, 452, 454, and 456 are arranged to extend longitudinally, substantially parallel to the tracks 432. The motor bank 450 and the motor bank 452 are positioned on opposite sides of the weight 152. The motor bank 454 and the motor bank 456 are positioned on opposite sides of the weight 150. In other embodiments, the motors 158 are otherwise arranged. By way of example, the motors 158 may be positioned near the ends of the tracks 732.

Figure 10:
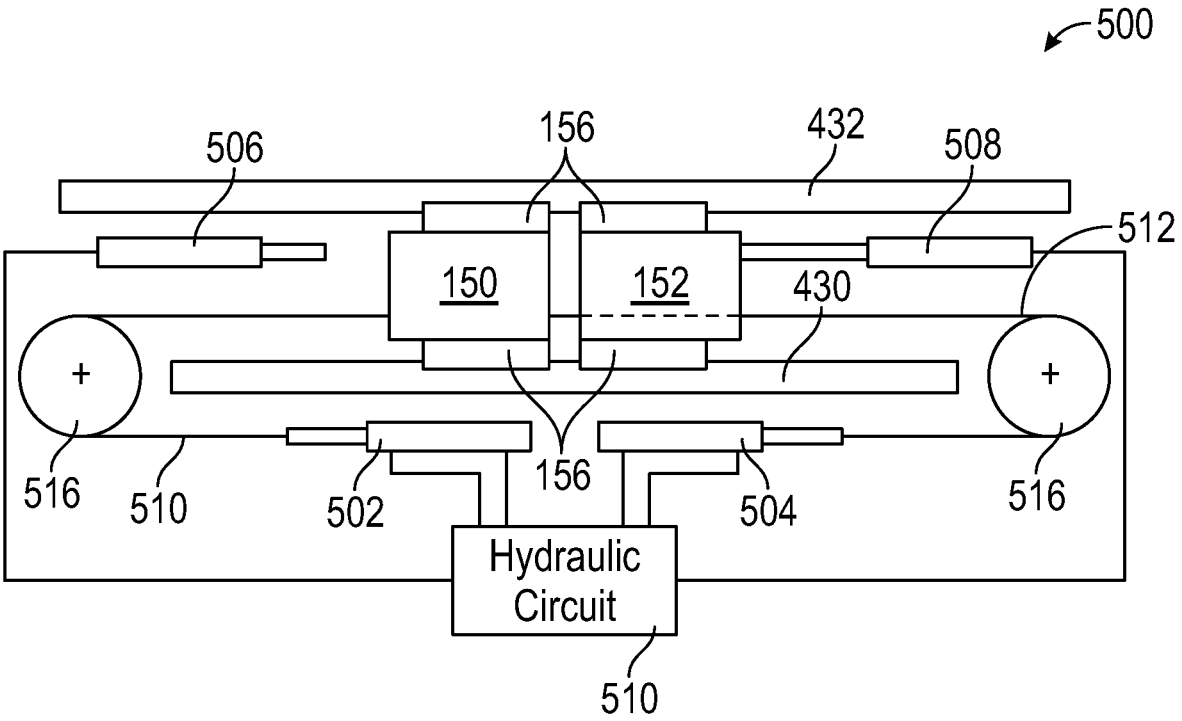
FIG. 10 is a side view of a rotating portion of the earthquake stabilization system of FIG. 1, according to another exemplary embodiment.

Referring to FIG. 10, a rotating portion 500 is shown as an alternative embodiment of the rotating portion 400. The rotating portion 500 may be substantially similar to the rotating portion 400 except as otherwise specified herein. In this embodiment, the motors 158 are replaced with linear actuators, shown as hydraulic cylinders 502, 504, 506, and 508. The hydraulic cylinders 502, 504, 506, and 508 are controlled by a hydraulic circuit 510, which may include pumps, reservoirs, valves, or hydraulic components. The hydraulic circuit 510 may in turn be controlled by the controller 202.

The hydraulic cylinder 502 is coupled to a first side of the weight 150 by a tensile member 512 (e.g., a cable, a rope, a chain, etc.). The hydraulic cylinder 504 is coupled to a second side of the weight 150 by a tensile member 514. The tensile members 512 and 514 each extend around an idler wheel, shown as pulley 516, that rotates freely. When the hydraulic cylinder 502 retracts, the hydraulic cylinder 502 applies a tensile force to the tensile member 512, which causes the weight 150 to move to the left as shown in FIG. 10. When the hydraulic cylinder 504 retracts, the hydraulic cylinder 504 applies a tensile force to the tensile member 514, which causes the weight 150 to move to the right as shown in FIG. 10. The hydraulic cylinder 506 is positioned to contact the first side of the weight 150. Accordingly, the hydraulic cylinder 506 can extend to force the weight 150 to the right as shown in FIG. 10. The hydraulic cylinder 508 is fixedly coupled to the weight 152. Accordingly, the hydraulic cylinder 508 can extend or retract to move the weight 152 left or right as shown in FIG. 10, respectively.

Figure 11:
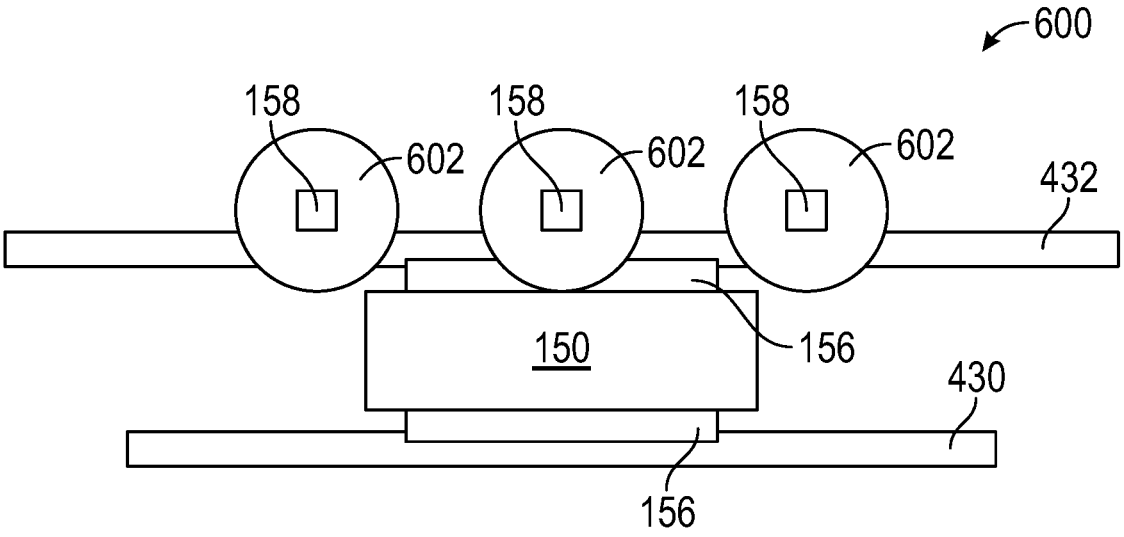
FIG. 11 is a side view of a rotating portion of the earthquake stabilization system of FIG. 1, according to another exemplary embodiment.

Referring to FIG. 11, a rotating portion 600 is shown as an alternative embodiment of the rotating portion 400. The rotating portion 600 may be substantially similar to the rotating portion 400 except as otherwise specified herein. In this embodiment, the motors 158 are each coupled to a driving wheel, shown as accelerating wheel 602. The accelerating wheels 602 are positioned to contact an exterior surface of the weight 150 when the weight 150 is within a certain range of positions. Additional accelerating wheels 602 may be added such that the weight 150 is constantly in contact with at least one of the accelerating wheels 602. The motors 158 drive the accelerating wheels 602, and the accelerating wheels 602 in turn drive the weight 150 along the track path 130 through engagement (e.g., frictional engagement) between the accelerating wheels 602 and the weight 150. In other embodiments, similar accelerating wheel 602 arrangements are used to drive the weight 122 and/or the weight 152.

Figure 12:
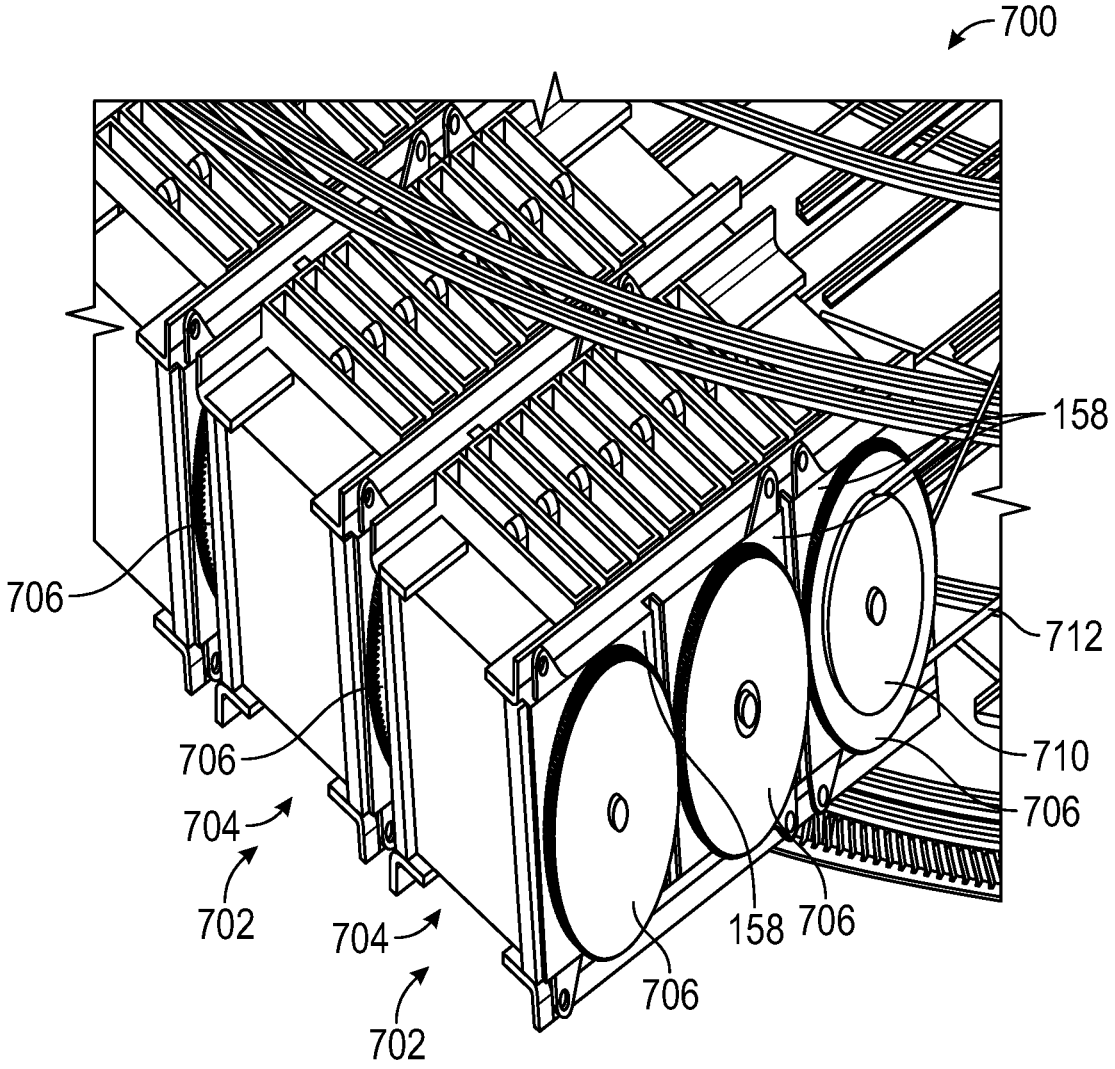
FIGS. 12 and 13 are perspective views of a rotating portion of the earthquake stabilization system of FIG. 1, according to another exemplary embodiment.
Figure 13:
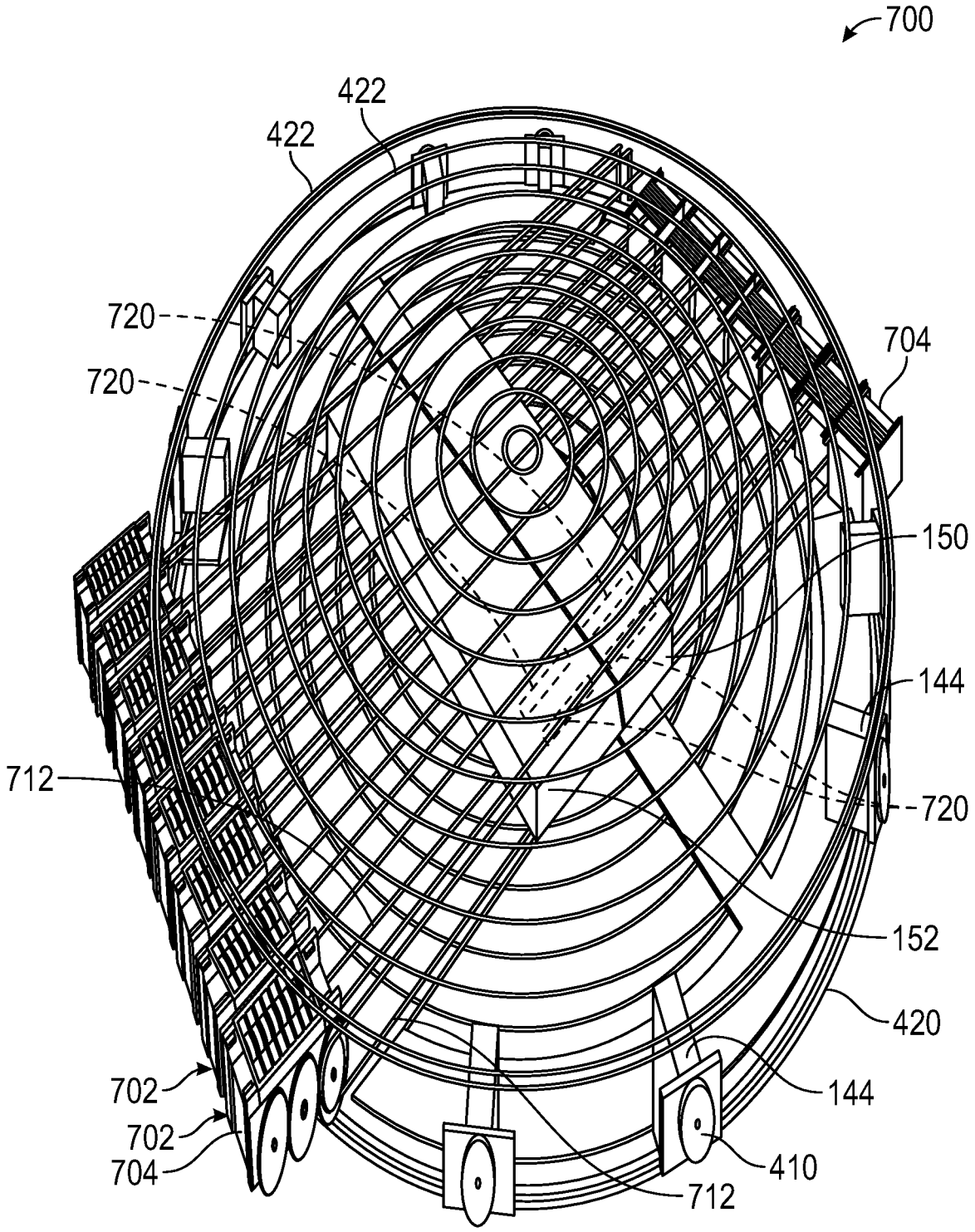

Referring to FIGS. 12 and 13, a rotating portion 700 is shown as an alternative embodiment of the rotating portion 400. The rotating portion 700 may be substantially similar to the rotating portion 400 except as otherwise specified herein. In this embodiment, the rotating portion 700 includes a series of driving assemblies, shown as cable assemblies 702. Each cable assembly 702 includes a pair of drive assemblies, shown as motor boxes 704. Each motor box 704 includes three of the motors 158 positioned adjacent one another. The output shafts of each motor 158 within a motor box 704 are each coupled to a spur gear, shown as gear 706, forming a gear train. One of the gears 706 is fixedly coupled to a driving wheel, shown as pulley 710. The pulleys 710 of each cable assembly 702 engage a tensile member, shown as cable 712. The cable 712 extends through the weight 150 and the weight 152, around a first pulley 710 of a first motor box 704, and around a second pulley 710 of a second motor box 704.

In some embodiments, the cables 712 of certain cable assemblies 702 are fixedly coupled to the weight 150, and the cables 712 of other cable assemblies 702 are fixedly coupled to the weight 152. Accordingly, each cable assembly 702 can be used to drive the corresponding weight. In other embodiments, the weights 150 and 152 each include a series of locking mechanisms 720 that are configured to selectively couple the weights 150 and 152 to the cables 712. By way of example, each locking mechanism 720 may include a solenoid-powered brake that engages a cable 712 to limit movement of the cable 712 relative to the weight 150 or the weight 152. The locking mechanisms 720 may be operated by the controller 202. In such an embodiment, some or all of the cable assemblies 702 may be used to drive the weight 150 and/or the weight 152, as designated by the controller 202.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of building 10 and the earthquake stabilization system 100 as shown in the various exemplary embodiments is illustrative only. Additionally, any element disclosed in one embodiment may be incorporated or utilized with any other embodiment disclosed herein. By way of example, the accelerating wheels 602 of the rotating portion 600 shown in FIG. 11 may be incorporated into the rotating portion 400 of FIG. 5. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A stabilization system comprising:

a stabilization assembly configured to couple to a floor structure of a building, the stabilization assembly including:

a track defining a track path;

a first weight slidably coupled to the track; and a first actuator configured to move the first weight along the track path;

a drive wheel coupled to the first actuator;

a tensile member engaging the drive wheel and coupled to the first weight, wherein the first actuator is configured to rotate the drive wheel to apply a tensile force on the tensile member and move the first weight along the track path;

a second weight slidably coupled to the track; and a second actuator configured to move the second weight along the track path, independent of movement of the first weight.

2. The stabilization system of claim 1, wherein the stabilization assembly further includes:

a rotating platform coupled to the track, the rotating platform configured to rotatably couple to the floor structure of the building; and a rotation actuator configured to rotate the rotating platform and the track relative to the building.

3. The stabilization system of claim 2, wherein the track is a first track, wherein the stabilization assembly further includes a second track configured to be fixedly coupled to the floor structure, and wherein the rotating platform is configured to align the first track with the second track such that the first weight can be selectively slidably coupled to the second track.

4. The stabilization system of claim 1, wherein the drive wheel is a sprocket and the tensile member is a chain.

5. The stabilization system of claim 1, wherein the tensile member is a first tensile member, and wherein the stabilization assembly further includes:

a second tensile member coupling the second actuator to the second weight;

an idler wheel engaging the second tensile member; and a shaft coupling the first actuator to the drive wheel, the shaft extending through the idler wheel, wherein the idler wheel is configured to rotate relative to the shaft.

6. The stabilization system of claim 5, wherein the first weight defines a passage extending therethrough, and wherein the second tensile member extends through the passage.

7. The stabilization system of claim 1, wherein the tensile member is a first tensile member, wherein the stabilization assembly further includes a second tensile member coupling the second actuator to the second weight, wherein the second weight defines a passage extending therethrough, and wherein the first tensile member extends from the drive wheel, through the passage, to the first weight.

8. The stabilization system of claim 1, wherein the track is a first track, further comprising a second track, wherein the first track and the second track extend parallel to one another, and wherein the first weight is slidably coupled to the first track and the second track.

9. The stabilization system of claim 8, wherein the first track and the second track are positioned within the same horizontal plane.

10. The stabilization system of claim 1, wherein the first weight is configured to move along the track path within a horizontal plane, wherein the first weight has a first dimension extending parallel to the track path, wherein the first weight has a second dimension extending perpendicular to the track path within the horizontal plane, and wherein the second dimension is larger than the first dimension.

11. The stabilization system of claim 1, further comprising:

a sensor configured to acquire measurement data relating to a seismic event; and a controller configured to:

determine a target response of the stabilization assembly that mitigates an effect of the seismic event on the building based on the measurement data; and control the first actuator to move the first weight along the track path according to the target response.

12. The stabilization system of claim 11, wherein the sensor is a first sensor, further comprising a second sensor, wherein the first sensor is configured to be positioned at a first distance from the building, wherein the second sensor is configured to be positioned at a second distance from the building that is greater than the first distance; and wherein the controller is configured to determine the target response based on (a) the measurement data acquired by the first sensor, (b) measurement data acquired by the second sensor, (c) a distance between the first sensor and the second sensor.

13. A stabilization system, comprising:

a stabilization assembly configured to couple to a floor structure of a building, the stabilization assembly including:

a track defining a track path;

a weight slidably coupled to the track;

an actuator configured to move the weight along the track path;

a first sensor configured to acquire measurement data relating to a seismic event;

a controller configured to:

determine a target response of the stabilization assembly that mitigates an effect of the seismic event on the building based on the measurement data, control the actuator to move the weight along the track path according to the target response; and a second sensor, wherein the first sensor is configured to be positioned at a first angular position relative to the building, wherein the second sensor is configured to be positioned at a second angular position relative to the building that is different from the first angular position, and wherein the controller is configured to determine the target response based on (a) the measurement data acquired by the first sensor, (b) measurement data acquired by the second sensor, (c) the first angular position of the first sensor, and (d) the second angular position of the second sensor.

14. The stabilization system of claim 13, wherein the stabilization assembly further includes:

a rotating platform coupled to the track, the rotating platform configured to rotatably couple to the floor structure of the building; and a rotation actuator configured to rotate the rotating platform and the track relative to the building.

15. The stabilization system of claim 14, wherein the track is a first track, wherein the stabilization assembly further includes a second track configured to be fixedly coupled to the floor structure, and wherein the rotating platform is configured to align the first track with the second track such that the weight can be selectively slidably coupled to the second track.

16. The stabilization system of claim 13, wherein the track is a first track, further comprising a second track, wherein the first track and the second track extend parallel to one another, and wherein the weight is slidably coupled to the first track and the second track.

17. The stabilization system of claim 16, wherein the first track and the second track are positioned within the same horizontal plane.

18. The stabilization system of claim 13, wherein the weight is configured to move along the track path within a horizontal plane, wherein the weight has a first dimension extending parallel to the track path, wherein the weight has a second dimension extending perpendicular to the track path within the horizontal plane, and wherein the second dimension is larger than the first dimension.

19. A stabilization system for a building, the stabilization system comprising:

a first track defining a track path;

a weight slidably coupled to the first track;

a first actuator;

a drive wheel coupled to the first actuator;

a tensile member engaging the drive wheel and coupled to the weight, wherein the first actuator is configured to rotate the drive wheel to apply a force on the tensile member and move the weight along the track path;

a platform coupled to the first track;

a second actuator configured to rotate the platform and the first track relative to a floor structure of the building; and a second track configured to be fixedly coupled to the floor structure, wherein the first track is configured to align with the second track such that the weight can be selectively slidably coupled to the second track.

20. The stabilization system of claim 19, wherein the drive wheel is a sprocket and the tensile member is a chain.

* * * * *